United States Patent [19]

Hosoi et al.

[11] Patent Number: 4,460,199

[45] Date of Patent: Jul. 17, 1984

[54] MICROCAPSULE COATED SHEET FOR PRESSURE SENSITIVE COPYING PAPER

[75] Inventors: Noriyuki Hosoi; Hiroharu Matsukawa; Yasuhiro Ogata, all of Shizuoka, Japan

[73] Assignee: Fuji Photo Film Co., Ltd., Kanagawa, Japan

[21] Appl. No.: 384,120

[22] Filed: Jun. 1, 1982

[30] Foreign Application Priority Data

May 29, 1981 [JP] Japan ..... 56-82161

[51] Int. Cl.[3] ..... B41M 5/22

[52] U.S. Cl. ..... 346/207; 428/320.6; 428/323; 428/326; 428/327; 428/341; 428/342; 428/354; 428/914; 346/214; 346/200; 346/226

[58] Field of Search ..... 282/27.5; 427/150–153; 428/320.4–320.8, 323, 326, 327, 488, 537, 913, 914, 341, 342, 354, 411

[56] References Cited

FOREIGN PATENT DOCUMENTS 90854 7/1975 Japan ..... 282/27.5

*Primary Examiner*—Bruce H. Hess

*Attorney, Agent, or Firm*—Sughrue, Mion, Zinn, Macpeak & Seas

[57] ABSTRACT

A microcapsule coated sheet for pressure sensitive copying paper, which comprises a support having provided thereon, in sequence, a first coating layer primarily comprising (1) microcapsules retaining an oil containing an electron donating color former dissolved or dispersed therein and (2) inorganic or organic solid fine particles which do not substantially form color when in contact with said electron donating color former, and a second coating layer primarily comprising an adhesive.

8 Claims, No Drawings

MICROCAPSULE COATED SHEET FOR PRESSURE SENSITIVE COPYING PAPER

FIELD OF THE INVENTION

This invention relates to a microcapsule coated sheet for pressure sensitive copying paper, more particularly, to a microcapsule coated sheet which has excellent copying ability for typewriting or hand-writing, and which exhibits less stain formation in handling during production, processing, etc.

BACKGROUND OF THE INVENTION

Pressure sensitive copying papers utilizing the coloration reaction between an electron donating color former and an electron accepting color developer are widely known, and examples thereof are given in U.S. Pat. Nos. 2,711,375, 2,712,507, 2,730,456, 2,730,457, 3,617,334, Japanese Patent Publications 18317/63, 1178/72, 20972/72, etc.

Conventional pressure sensitive copying papers comprise a combination of:

(1) a microcapsule coated sheet comprising a support sheet having coated thereon microcapsules retaining a color former-containing oil prepared by dissolving an electron donating color former in a water-insoluble organic solvent together with an adhesive and inorganic or organic solid fine particles (hereinafter referred to as a protective agent or protectant) which do not substantially form color when in contact with the electron donating color former; and (2) a color developer sheet comprising a support sheet having coated thereon an acid reactive substance capable of forming a colored image by reaction with the color former. To obtain images, the microcapsule coated sheet and the color developer sheet are superposed on each other in such a manner that the microcapsule coated surface comes into contact with the color developer coated surface and pressure is applied to the assembly using, e.g., a pen or a typewriter. Upon application of pressure, the capsules are ruptured to release the color former containing oil which migrates to the color developer sheet to effect reaction between the color former and the color developer to provide a darkly colored image.

Such pressure sensitive copying papers utilizing the pressure rupturable properties of microcapsules have the defect that the microcapsules rupture during handling of the paper during production, processing, printing, chit forming, etc., to result in undesired coloration or stain. Thus, there has been an increasing demand for a means to overcome the above described defect.

Microcapsule protecting agents have been proposed to overcoming the defect, e.g., mixing a fine cellulose powder (see U.S. Pat. No. 2,711,375), starch particles (British Pat. No. 1,232,347, Japanese Patent Publication Nos. 1178/72 and 33204/73), glass beads (U.S. Pat. No. 2,655,453), thermally expandable high polymer particles (microspheres) (Japanese Patent Application (OPI) 32013/73) (The term "OPI" as used herein refers to a "published unexamined Japanese patent application"), etc., with the microcapsules as a protective agent and coating the resulting mixture on paper.

The use of the above described protective agents in high amounts removes the above described defect but is accompanied by the different defect of reducing the copying ability of the resulting pressure sensitive copying paper.

In addition, various approaches have tried using an adhesive used for adhering the microcapsules and high amounts of the protective agent to a support sheet to prevent stain in the aforesaid production, processing, printing, chit forming, etc., but the defects of a reduction in copying ability and increased production costs have resulted.

Japanese Patent Application No. 90854/75 proposes providing a second coating layer mainly comprising an adhesive and a protective agent on the a coating layer mainly comprising microcapsules. This process prevent stains in handling during producing, processing, printing, chit forming, etc., but it somewhat deteriorates copying ability.

SUMMARY OF THE INVENTION

It is, therefore, an object of the present invention to provide a microcapsule coated sheet for pressure sensitive copying paper which undergoes less stain formation in handling during producing, processing, printing, chit forming, etc., and have an excellent copying ability.

Another object of the present invention is to provide a microcapsule coated sheet for pressure sensitive copying paper which can be produced at a low cost.

These objects of the present invention have been attained by a microcapsule coated sheet for pressure sensitive copying paper which comprises a support sheet having provided thereon, in sequence:

a first coating layer comprising (1) microcapsules retaining an oil containing an electron donating color former dissolved or dispersed therein; and (2) inorganic or organic solid fine particles which do not substantially form color when in contact with the electron donating color former; and a second coating layer comprising an adhesive.

DETAILED DESCRIPTION OF THE INVENTION

The microcapsule coated sheet of the present invention uses an adhesive which effectively perform the functions of not wearing out due to forces applied thereto in handling the sheet during production, processing, etc., and preventing rupture of microcapsules due to the movement thereof of the microcapsules.

In addition, since penetration of adhesive into the support sheet is reduced, the adhesive effectively performs its function with decreased amounts of coated adhesive leading to a reduction in production cost.

As the electron donating color former used in the present invention, those which are conventionally used are useful herein, i.e., those which are essentially colorless and which contain a lactone, lactam, sultone, spiropyran, ester, amide or like skeleton and which undergo ring opening or cleavage when in contact with a color developer. Specific examples thereof include triarylmethane compounds, diphenylmethane compounds, xanthene compounds, thiazine compounds, spiropyran compounds, etc. Specific examples include Crystal Violet Lactone, Benzoyl leucomethylene blue, Malachite green lactone, Rhodamine B lactam, 1,3,3-trimethyl-6'-ethyl-8'-butoxyindolinobenzospiropyran, etc.

These color formers are usually used as a combination of one or more "rapidly coloring" color former with one or more "delayed action" color formers.

As the oil used upon microencapsulation for dissolving these color formers, those which dissolve color former in a proportion of 5 wt % or more, particularly Crystal Violet Lactone in a proportion of about 10 wt % or more, are preferred.

Specific examples of such oils include aliphatic compounds and aromatic compounds such as chlorinated paraffins (chlorination degree: about 15 to about 60), alkyl- or aralkylbenzenes or naphthalenes (alkyl moiety containing about 5 or less carbon atoms) (e.g., triphenylmethane, diphenyltolylmethane, diarylalkanes such as xylylphenylethane, benzylxylene, α-methylbenzyltoluene, etc., diisopropylnaphthalene, isobutylbiphenyl, tetrahydronaphthalene, etc.), hydrogenated terphenyl, di-α-methylbenzyl, tert-butyl-diphenyl ether, hydrogenated styrene dimer, food oils, cotton seed oil, etc. These oils (solvents) may be used alone or as a combination of two or more thereof. The use of a poor solvent for the color former, such as low boiling paraffin or alkylbenzene in a proportion of 20 wt % or less, is effective to prevent fogging on printing, which is suitable in medium paper. Further, a coloration rate improving agent, an oxidation preventing stabilizer, etc., as are conventionally used can be added to the color former containing solution.

As processes for producing color former retaining microcapsules used in the present invention, conventional process are used, e.g., phase separation from an aqueous solution (U.S. Pat. Nos. 2,800,457, 2,800,458, etc.), interfacial polymerization (Japanese Patent Publications 19,574/63, 446/67, 771/67, 2,882/67, 2,883/67, 8,693/67, 9,654/67, 11,344/67, Japanese Patent Application (OPI) 9,097/76, U.S. Pat. No. 3,287,154, British Pat. Nos. 950,443, 1,046,409, etc.), polymerization of a wall material in oil droplets (Japanese Patent Publications 9,168/61, 45,133/74, etc.), melting, dispersing and cooling (British Pat. Nos. 952,807, 965,074, etc.), precipitating a polymer (U.S. Pat. Nos. 3,418,250, 3,660,304, and Japanese Patent Publication No. 23,165/72), polymerization of reactants from inside an oil droplet (U.S. Pat. Nos. 3,726,804, 3,796,669, etc.), and the like.

The size of microcapsules is not limited at all, but a size of 3 to 20μ is preferable.

As the protective agents used in the present invention, there are used organic or inorganic particles or fibrous substances which are solid at ordinary room temperature and which do not substantially form color when in contact with an electron donating color former. Specific examples include starch particles (for example, British Pat. No. 1,232,347, etc.), fine polymer powders (U.S. Pat. No. 3,652,736, etc.), color former free microcapsule particles (British Pat. No. 1,235,991, etc.), inorganic particles of talc, kaolin, bentonite, agalmatolite, zinc oxide, titanium oxide, alumina or the like, fine cellulose powder (U.S. Pat. No. 3,625,736, etc.), and the like.

With particulate protectants, the average particle size most suitably ranges from 3 to 50μ, preferably 5 to 40μ, in terms of volume average diameter. These particles are effectively larger than the color former retaining microcapsules. On the other hand, fibrous substances most suitably have a length of 50 to 600μ, preferably 100 to 400μ and a diameter of 3 to 20μ.

Of the above described protective agents, starch particles are particularly preferred. Examples of such starch particles include corn starch, potato starch, sweet potato starch, bean starch, wheat starch, rice starch, tapioca starch, sago, etc., with corn starch, wheat starch, bean starch and tapioca starch being particularly preferred.

In the present invention, the first coating layer comprising microcapsules and a protective agent is a layer provided by coating a mixture of the aforesaid microcapsules and the protective agent. The mixing ratio and the coating amount are specifically not limited. However, the mixing ratio of microcapsule/protective agent is preferably 1/0.2 to ½ by weight parts, and the coating amount is preferably 2 g/m$^2$ to 7 g/m$^2$ as a dry weight.

In addition to the above described microcapsules and protective agents, an adhesive, a surfactant and other conventionally known additives and antioxidants may be added to the first layer.

As the surfactant, various anionic, cationic, nonionic and amphoteric surfactants can be used in the amount of 0.1 to 5 wt % (as a solid state) based on the weight of the coating materials. Anionic surfactants used include fatty acid soaps, metallic soaps, sulfonated oil, Turkey red oil, alkyl sulfates, polyoxyethylene alkyl ether sulfates, polyoxyethylene alkylaryl ether sulfates, higher fatty acid alkanolamide sulfates, alkylsulfinates, alkylbenzenesulfonates, alkylarylsulfonates, dialkylsulfosuccinates, higher fatty acid alkylolamide sulfonates, alkyl phosphates, etc. Cationic surfactants used include alkylamines, quaternary ammonium salts, alkylpyrydinium salts, etc. Nonionic surfactants used include fatty acid glycerides, polyoxyethylene fatty acid esters, polyoxyethylene alkyl ethers, polyoxyethylene alkylaryl ethers, sorbitan fatty acid esters, sucrose fatty acid esters, polyethylene sorbitan fatty acid esters, polyoxyethylenealkylamines, polyoxyethylene fatty acid amides, polyoxyethylene polypropylene glycol ethers, etc. Amphoteric surfactants used include alkylbetaines, imidazoline derivatives, etc. In the above described surfactants, the carbon atom of alkyl groups therein is preferably 4 to 20.

As the adhesive used in the present invention, there are latexes such as a styrene-butadiene rubber latex, a styrene-butadiene latex, an acrylonitrile latex, styrene-maleic anhydride copolymer latex, etc.; water-soluble natural high polymer compounds such as proteins (e.g., gelatin, gum arabic, albumin, casein, etc.), celluloses (e.g., carboxymethyl cellulose, hydroxyethyl cellulose, etc.), saccharoses (e.g., agar-agar, sodium alginate, starch, carboxymethyl starch, etc.), etc.; water-soluble synthetic high polymer compounds such as polyvinyl alcohol, polyvinyl pyrrolidone, polyacrylic acid, polyacrylamide, etc.; and the like. The liquid used for suspending the above latexes is preferably water, more preferably aqueous solution containing a surfactant.

These high polymers used as adhesives (binders) advantageously possess an average molecular weight of about 1,000 to 10,000,000, particularly 10,000 to 5,000,000.

In addition, from the point of view of production suitability, adhesives (binders) having a viscosity of 500 cps measured at 25° C. as an aqueous solution containing 10% solids are preferable. Specific examples of such binders include a styrene-butadiene rubber latex, a styrene-butadiene latex, an acrylonitrile latex, a styrene-maleic anhydride copolymer latex, carboxymethyl cellulose, starch, polyvinyl alcohol, polyacrylic acid, etc., more preferably polyvinyl alcohol and starch.

In the present invention, a second coating layer comprising an adhesive is provided on the aforesaid first coating layer. The amount of adhesive coated is selected according to the kind of adhesive and the coated amounts of microcapsules and protectants, with 0.1 $g/m^2$ to 2 $g/m^2$ being preferred.

The second layer mainly comprising an adhesive can contain 0.1 to 5% by weight of surfactants such as were described hereinbefore.

The support used in the present invention includes generally used woodfree paper, middle-quality paper, ground wood paper, machine coated paper, flint paper, art paper, cast coated paper, synthetic paper, resin-coated paper, plastic films, etc.

When using paper, the ratio of L material (hardwood pulp) to N material (softwood pulp), content of clay, sizing agent (neutral or acidic), surface-sizing agent, etc., in the base paper are not limited and are conventional. For example, 45 to 60μ thick ordinary paper obtained by using a base paper having an L/N ratio of 1:1, incorporating 5 vol % talc as a clay, conducting neutral sizing with a conventional long chain dibasic acid tetrahydrate and surface sizing with starch can be used. Upon applying the surface sizing agent, basic inorganic pigments or color developers may be used therein.

In coating the first coating layer comprising microcapsules and a protective agent and the second coating layer comprising an adhesive, conventional coating methods can be used such as air knife coating, bar coating, blade coating, rod coating, roller coating, fountain coating, gravure coating, spray coating, dip coating, extrusion coating, etc. (See, for example, Japanese Patent Publication No. 35,330/74, British Pat. Nos. 1,339,082 and 1,176,469, U.S. Pat. Nos. 3,186,851 and 3,472,674, etc.).

In coating these layers, a first coating layer forming solution is first coated and, before the first layer is dried, a second coating layer forming solution is coated thereon, or the second layer forming solution may be coated on the first coating layer after drying the first layer by hot air or infrared rays.

Further, the two layers may be simultaneously coated using a simultaneous multi-coating apparatus as disclosed in Japanese Patent Publication No. 12,390/70.

In practicing the present invention, the simultaneous multi-coating method is most preferable due to its simplicity and easiness in providing the desired intended stratum structure.

To use the simultaneous multi-coating method, the use of surfactants as described hereinbefore is necessary. The amount of the surfactants used is preferably 0.1 to 5% by weight, more preferably 0.2 to 2% by weight, based on the weight of the coating materials. Surfactants particularly suited for the simultaneous multi-coating include alkyl sulfates, dialkyl sulfosuccinates, alkylbenzenesulfonates, alkyl phosphates, nonionic surfactants having an HLB of 10 to 16, alkylbetaine surfactants, etc.

Steps other than the coating step may also be conducted in a conventional manner; for example, drying may be conducted by applying air to the coated surface, with the non-coated surface conveyed on rolls, without using canvas, by applying air from both sides with carrying in a non-contacted manner, or by using an air cap while winding the web around a hot cylinder.

The present invention will now be described in more detail by reference to examples of prefereed embodiments of the present invention which, however, are not to be construed as limiting the present invention in any way. Parts and % are by weight, and the coating amounts are all presented as dry weight.

EXAMPLE 1

6 Parts of pig skin acid-processed gelatin and 6 parts of gum arabic were dissolved in 30 parts of water at 40° C. Then, 0.2 part of sodium nonylbenzenesulfonate was added thereto as an emulsifier. 30 Parts of diisopropylnaphthalene oil containing 2.5% crystal violet lactone and 2% benzene leucomethylene blue dissolved therein was added to the above described solution and emulsified therein. 200 Parts of water at 40° C. was added thereto and, while continuing stirring, 20% hydrochloric acid was dropwise added thereto to adjust the pH to 4.4. This solution was cooled to 20° C. and then 2.0 parts of a 37% formaldehyde solution was added thereto followed by adding 20 parts of a 7% solution of carboxymethyl cellulose sodium salt. The pH of the solution was then adjusted to 10 by adding thereto a 10% sodium hydroxide solution and the resulting solution was allowed to stand for 20 hours at room temperature to prepare a microcapsule containing solution containing 24% solids.

20 parts of wheat starch having a volume average diameter of 12μ was added to the thus obtained microcapsule solution to obtain a coating solution for forming a first coating layer.

Next, 10 parts of polyvinyl alcohol having an average polymerization degree of 500 and a saponification degree of 98% and 10 parts of oxidized starch were dissolved in 80 parts of water while heating at 90° C. to obtain a coating solution for forming a second coating layer.

The thus obtained solution for forming a first coating layer was coated on a paper web (1 m and 80 cm in width) conveyed at a speed of 300 m/min in a coating amount of 4.5 $g/m^2$ using a bar coater and, before the coated layer was dried, the above described solution for forming a second coating layer was coated thereon in a coating amount of 0.5 $g/m^2$ using an air knife coater, followed by drying at 120° C. with hot air to obtain a microcapsule coated paper for pressure sensitive copying paper.

Separately, 200 parts of active clay were dispersed in 800 parts of water and the resulting mixture was adjusted to pH 10.0 by adding a 20% sodium hydroxide aqueous solution. To this dispersion were added 40 parts (as solids) of styrene-butadiene copolymer latex (Sumitomo Naugatack SN-304) and 60 parts of a 10% corn starch aqueous solution to prepare a color developer solution. This solution was coated on a paper web in a coating amount of 6 $g/m^2$ by an air knife coating method.

The thus obtained microcapsule coated paper and the color developer coated paper were superposed one over the other. When pressure was applied by writing, good color density was obtained.

In handling other than printing, no coloration was observed, i.e., no stain was formed.

(1) Low-pressure color stain and (2) abrasion stain were then examined as tests for estimating the stain formation during handling of the paper during production, processing, printing, chit forming, etc.

(1) Low-pressure color stain was tested by superposing the microcapsule coated side of the microcapsule coated paper on the color developer coated side of the color developer coated paper and applying a pressure of 20 $kg/cm^2$ using a hydraulic loading machine to examine the degree of coloration.

(2) Abrasion stain was tested by placing the color developer coated paper on a plain desk and, after superposing the microcapsule coated paper thereon, placing a 300 g weight of 10 $cm^2$ in bottom area on the assembly and then moving it across the desk a distance of 30 cm with the microcapsule coated paper thereunder to examine the degree of color stain formed on the color developer coated surface.

The results thus obtained were rated in four ranks: rank 1 . . . not colored; rank 2 . . . slightly colored; rank 3 . . . colored; and rank 4 . . . seriously colored.

Samples ranked 1 or 2 are practically usable. However, samples ranked 3 or 4 have problems in practical use due to stains formed in handling during production, printing, chit forming, etc.

The sample prepared in Example 1 was rated rank 2 as to (1) low-pressure color stain and rank 2 as to (2) abrasion stain.

COMPARATIVE EXAMPLE 1

3.5 Parts of polyvinyl alcohol having an average polymerization degree of 500 and a saponification degree of 98% and 3.5 parts of oxidized starch were dissolved in 80 parts of water while heating at 90° C., and the resulting solution and 20 parts of wheat starch having a volume average diameter of 12μ were added to a microcapsule solution prepared in the same manner as in Example 1, followed by coating on a paper web in a coating amount of 5.0 g/$m^2$ by air knife coating to obtain a microcapsule coated paper for pressure sensitive copying paper.

The thus obtained microcapsule coated paper was superposed on the color developer coated paper obtained in Example 1. When pressure was applied thereto by writing, good color density was obtained.

However, in cutting, slight stains were observed. As to the tests (1) and (2), the sample was rated rank 4 as to (1) low-pressure color stain and rank 3 as to (2) abrasion stain.

EXAMPLE 2

5 Parts of an adduct of 3 mols of tolylene diisocyanate and 1 mol of trimethylolpropane and 1 part of actocall XS-550C (trade name of an adduct of polyol sorbitol and propylene oxide; made by Takeda Chemical Industries, Ltd.) were dissolved as microcapsule wall forming materials in 30 parts of diisopropylnaphthalene. This oily solution was gradually poured, with vigorous stirring, into a solution prepared by dissolving 15 parts of polyvinyl alcohol having an average polymerization degree of 1700 and a saponification degree of 88% in 20 parts of a 20° C. water to prepare an o/w emulsion. Under continuing stirring, 50 parts of water at 40° C. was added to the emulsion. Then, the temperature of the system was gradually raised to 90° C. and maintained at 90° C. for 20 minutes to complete microencapsulation. Thus, there was obtained a 40% solution of microcapsules containing diisopropylnaphthalene.

10 Parts of wheat starch having a volume average diameter of 12μ and 10 parts of cellulose floc having an average length of 200μ were added to the thus obtained microcapsule solution to obtain a coating solution for forming a first layer.

Then, 2 parts of gum arabic, 10 parts of polyvinyl alcohol having an average polymerization degree of 500 and a saponification degree of 98%, and 8 parts of carboxymethyl cellulose having an average polymerization degree of 200 were dissolved in 80 parts of water while heating at 90° C. to obtain a coating solution for forming a second layer.

The thus obtained coating solution for forming a first layer was coated on a paper web (1 m and 80 cm in width) conveyed at a speed of 300 m/min in a coating amount of 4.5 g/$m^2$ by air knife coating, and dried at 120° C. Then, the coating solution for forming a second layer was coated thereon in a coating amount of 0.8 g/$m^2$ by air knife coating, and dried at 120° C. using hot air to obtain a microcapsule coated paper for pressure sensitive copying paper.

Separately, there was prepared a 25 wt % dispersion of solids composed of 90 parts of talc having a volume average diameter of 2μ, 1.0 part of a naphthalenesulfonic acid-formalin condensate (Kao Denol N), 1.2 parts of zinc oxide (Sakai Kagaku Aenka No. 3), 9.5 parts of zinc 3,5-di-α-methylbenzylsalicylate, 3 parts of oxidized starch (Nihon Shokuhin Kako MS 3800), 5.5 parts of polyvinyl alcohol having an average polymerization degree of 1000 and a saponification degree of 88%, and 9 parts of carboxy-modified styrene-butadiene latex (Sumitomo Naugatack SN-304) using an attritor. This dispersion was coated on one side of a paper (1 m and 80 cm in width; 40 g/$m^2$ in basis weight; and 60 second gas transmission rate) in a coating amount of 0.36 g/$m^2$ of zinc di-α-methylbenzylsalicylate to obtain a color developer coated paper.

The thus obtained microcapsule coated paper and the color developer coated paper were superposed one over the other. When pressure was applied thereto by writing, good color density was obtained.

In handling other than printing, no coloration was observed, i.e., no stains were formed.

The sample was rated rank 2 as to (1) low-pressure color stain and rank 1 as to (2) abrasion stain.

COMPARATIVE EXAMPLE 2

10 Parts of wheat starch having a volume average diameter of 12μ and 10 parts of cellulose floc having an average length of 200μ were added to a microcapsule solution prepared in the same manner as in Example 2. Then, 1.3 parts of gum arabic, 6.3 parts of polyvinyl alcohol having an average polymerization degree of 500 and a saponification degree of 98%, and 5 parts of carboxymethyl cellulose having an average polymerization degree of 200 were dissolved in 80 parts of water while heating at 90° C., and added to the above microcapsule solution. The resulting coating solution was coated on a paper web in a coating amount of 5.3 g/$m^2$ by air knife coating to obtain a microcapsule coated paper for pressure sensitive copying paper.

The thus obtained microcapsule coated paper was superposed on the color developer coated paper obtained in Example 2. When pressure was applied thereto by writing, good color density was obtained.

However, in cutting, slight stains were observed. The sample was rated rank 4 as to (1) low-pressure color stain and rank 3 as to (2) abrasion stain.

EXAMPLE 3

5 Parts of partial sodium salt of polyvinylbenzenesulfonic acid (made by National Starch Co.; VERSA, TL500; mean molecular weight: 500,000) was added to 95 parts of an hot water (about 80° C.) and dissolved therein with stirring. The dissolution was completed in about 30 minutes, followed by cooling the system at 20° C. The resulting aqueous solution had a pH of 2 to 3. A 20 wt % sodium hydroxide aqueous solution was added thereto to adjust the pH to 4.0.

A hydrophobic solution prepared by dissolving 4 parts of crystal violet lactone (CVL) in 100 parts of KMC-113 (alkylnaphthalene mainly comprising diisopropylnaphthalene; made by Kureha Kagaku Kogyo K.K.) while heating was emulsified and dispersed in 100 parts of a 5% aqueous solution of the above described partial sodium salt of polyvinylbenzenesulfonic acid to obtain an emulsion having a mean particle size of 4.5μ.

Separately, 6 parts of melamine, 11 parts of a 37% by weight formaldehyde aqueous solution, and 83 parts of water were stirred at 60° C. for 30 minutes to obtain an aqueous solution of a mixture of melamine, formaldehyde, and a melamineformaldehyde precondensate having a pH of 6 to 8. This aqueous solution mixture was referred to as a precondensate solution. The precondensate solution obtained as described above was added to the aforesaid emulsion and mixed. The pH of the mixture was adjusted to 6.0 by adding thereto a 20 wt % acetic acid solution while stirring. Then, the solution temperature was raised to 65° C. and, after stirring for 60 minutes, the pH of the system was adjusted to 4.0 using 1N hydrochloric acid, followed by adding thereto 30 g of a 40 wt % urea aqueous solution. Stirring was continued while maintaining the temperature at 65° C. and, after 40 minutes, the pH of the system was adjusted to 9.0 using a 20 wt % sodium hydroxide to obtain a microcapsule solution.

To the thus obtained microcapsule solution were added 60 parts of corn starch having a volume average diameter of 15μ and 0.2 part of 2-ethylhexylsulfosuccinate to obtain a coating solution for forming a first layer.

Then, 10 parts of polyvinyl alcohol having an average polymerization degree of 500 and a saponification degree of 98% and 10 parts of oxidized starch were dissolved in 80 parts of water under heating, and 0.05 part of 2-ethylhexyl sulfosuccinate was added thereto to prepare a coating solution for forming a second layer.

The thus obtained coating solution for forming a first layer and the coating solution for forming a second layer were simultaneously coated on a paper web (1 m and 80 cm in width) conveyed at a speed of 500 m/min by curtain coating, the second layer becoming the upper layer, then dried by a hot air at 120° C. to obtain a microcapsule coated paper for forming pressure sensitive copying paper.

The coating amount of the first layer was 4.1 g/m$^2$ and the coating amount of the second layer was 0.4 g/m$^2$.

The thus obtained microcapsule coated paper and the color developer coated paper obtained in Example 1 were superposed one over the other. When pressure was applied thereto by writing, good color density was obtained.

In handling other than printing, no coloration was observed, i.e., no stains were formed.

The sample was rated rank 1 as to (1) low-pressure color stain and rank 2 as to (2) abrasion stain.

COMPARATIVE EXAMPLE 3

9.3 Parts of polyvinyl alcohol having an average polymerization degree of 500 and a saponification degree of 98% and 9.3 parts of oxidized starch were dissolved in 80 parts of water while heating at 90° C., and the resulting solution and 60 parts of corn starch were added to a microcapsule solution obtained in the same manner as in Example 3. Then, 0.2 part of 2-ethylhexyl sulfosuccinate was added thereto to obtain a coating solution.

The thus obtained coating solution was coated on a paper web (1 m and 80 cm in width) conveyed at a speed of 500 m/min in a coating amount of 4.5 g/m$^2$, then dried with hot air at 120° C. to obtain a microcapsule coated paper for forming pressure sensitive copying paper.

The thus obtained microcapsule coated paper was superposed on a color developer coated paper obtained as per Example 1. When pressure was applied thereto by writing, good color density was obtained.

However, in slit processing (cutting), slight stains were observed. The sample was rated rank 3 as to (1) low-pressure color stain and rank 4 as to (2) abrasion stain.

COMPARATIVE EXAMPLE 4

A coating solution for forming a first layer obtained in the same manner as in Example 3 was coated on a paper web (1 m and 80 cm in width) conveyed at a speed of 500 m/min and then dried by a hot air at 120° C. to obtain a microcapsule coated paper for forming pressure sensitive copying paper. The coating amount was 5 g/m$^2$.

The thus obtained microcapsule coated paper was superposed on a color developer coated paper obtained as per Example 1. When pressure was applied thereto by writing, good color density was obtained.

However, in slit processing (cutting), serious stains were formed, thus the sample being inpracticable for use.

The sample was rated rank 4 as to (1) low-pressure color stain and rank 4 as to (2) abrasion stain.

While the invention has been described in detail and with reference to specific embodiments thereof, it will be apparent to one skilled in the art that various changes and modifications can be made therein without departing from the spirit and scope thereof.

What is claimed is:

1. A microcapsule coated sheet for pressure sensitive copying paper, comprising a support having provided thereon, in sequence, a first coating layer comprising (1) microcapsules retaining an oil containing an electron donating color former dissolved or dispersed therein and (2) a protective agent, wherein the protective agent is larger than said microcapsules and comprises inorganic or organic solid fine particles which do not substantially form color when in contact with said electron donating color former, and a second coating layer consisting essentially of an adhesive.

2. A microcapsule coated sheet as in claim 1, wherein the mixing ratio of said microcapsule to said protective agent is 1/0.2 to ½ parts by weight.

3. A microcapsule coated sheet as in claim 1, wherein the coating amount of the first coating mixture is 2 g/m$^2$ to 7 g/m$^2$ as a dry weight.

4. A microcapsule coated sheet as in claim 1, wherein the amount of said adhesive coated is 0.1 g/m$^2$ to 2 g/m$^2$.

5. A microcapsule coated sheet as in claim 1, wherein said adhesive is polyvinyl alcohol or starch.

6. A microcapsule coated sheet as in claim 1, wherein said protective agent has an average particle size of from 3 to 50μ in terms of average volume diameter.

7. A microcapsule coated sheet as in claim 1, wherein said protective agent has an average particle size of from 5 to 40μ in terms of average volume diameter.

8. A microcapsule coated sheet as in claim 1, wherein said protective agent is starch particles.

* * * * *